US006694582B1

(12) United States Patent
Agrikli

(10) Patent No.: US 6,694,582 B1
(45) Date of Patent: Feb. 24, 2004

(54) METHOD AND MACHINE FOR UNRAVELING KNITTED FABRICS

(76) Inventor: Mehmet Agrikli, Agteks Orme ve Tekstil Endustrileri San. ve Tic. Ltd. STI. Altintepsi Mah. Poyraz Sok. No:2, Bayrampasa 34160 Istanbul (TR)

( * ) Notice: Subject to any disclaimer, the term of this patent is extended or adjusted under 35 U.S.C. 154(b) by 0 days.

(21) Appl. No.: 09/958,634

(22) PCT Filed: May 28, 1999

(86) PCT No.: PCT/TR99/00022

§ 371 (c)(1),
(2), (4) Date: Feb. 11, 2002

(87) PCT Pub. No.: WO00/61849

PCT Pub. Date: Oct. 19, 2000

(30) Foreign Application Priority Data

Apr. 14, 1999 (TR) ..... 1999/00813

(51) Int. Cl.[7] ..... D04B 19/00
(52) U.S. Cl. ..... 28/171; 28/218
(58) Field of Search ..... 28/218, 248, 171, 28/170, 100, 299; 66/1 R, 125 R, 125 A, 203, 213; 242/485, 413; 57/2.3, 332, 334, 335, 336, 337, 351

(56) References Cited

U.S. PATENT DOCUMENTS

| | | | | | |
|---|---|---|---|---|---|
| 1,399,657 | A | * | 12/1921 | Robischon | 28/171 |
| 1,533,728 | A | * | 4/1925 | Drenk | 28/171 |
| 2,061,233 | A | * | 11/1936 | Gastrich | 28/171 |
| 3,326,481 | A | * | 6/1967 | Frickert | 242/485 |
| 3,413,700 | A | * | 12/1968 | Abowitz | 28/171 |
| 3,720,984 | A | * | 3/1973 | Roberson, Jr. | 28/218 |
| 4,091,512 | A | * | 5/1978 | Chambley et al. | 28/218 |
| 4,530,137 | A | * | 7/1985 | Moss et al. | 28/171 |
| 4,870,839 | A | * | 10/1989 | Odham | 66/125 A |
| 5,113,564 | A | * | 5/1992 | Suzuki | 28/218 |
| 6,301,937 | B1 | * | 10/2001 | Tatzel et al. | 66/1 R |
| 6,321,427 | B1 | * | 11/2001 | Auguste et al. | 28/218 |

FOREIGN PATENT DOCUMENTS

| | | |
|---|---|---|
| FR | 1 299 701 A | 12/1962 |
| GB | 2 247 473 A | 3/1992 |
| WO | WO 81 03670 A | 12/1981 |

* cited by examiner

*Primary Examiner*—Amy B. Vanatta
(74) *Attorney, Agent, or Firm*—Harrison & Egbert

(57) ABSTRACT

Methods for unraveling knitted fabrics and a machine for unraveling knitted fabrics in order to reuse the yarns of a knitted fabric to be unraveled; the methods providing that the yarns can be unraveled either by stretching and loosening the yarns or by twisting the yarn plies onto each other whatever the knit type and the number of yarns are and the methods having stretching-loosening and twisting characteristics. The machine for unraveling knitted fabrics operates by the use of the methods and includes units for unraveling knitted fabrics in a desired number, each of the units consisting of yarn guide passages, yarn feeders, a yarn winding unit, an optionally stretchable tension/reservoir arm wherein the position of the arm is detected by a sensor, and a mechanism for twisting yarns with plies, the yarn feeders and the yarn winding unit being able to rotate in two directions and being actuated by motors, the machine being able to unravel the yarns by controlling its own units individually or together in a particular number thereof, and determining that the yarns are loosened/stretched and determining the knit order via a control unit.

18 Claims, 15 Drawing Sheets

FIG. 5-a
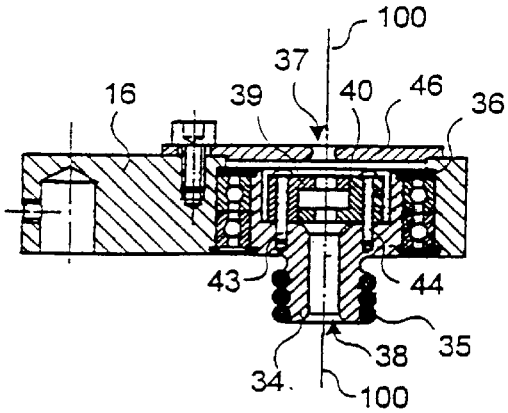
FIG. 5-b
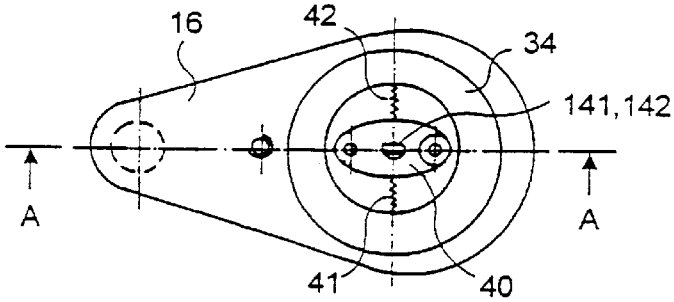
FIG 6-a
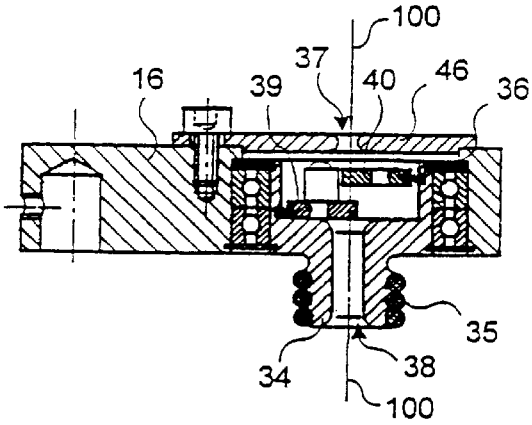
FIG 6-b
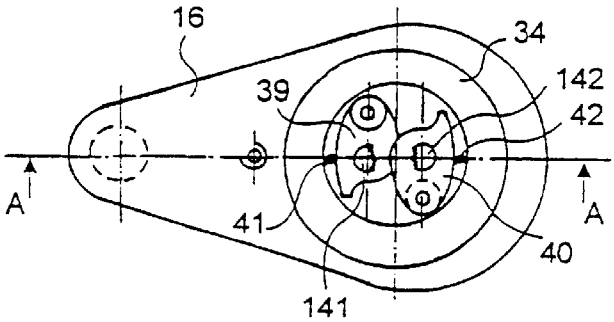

FIG. 7-a
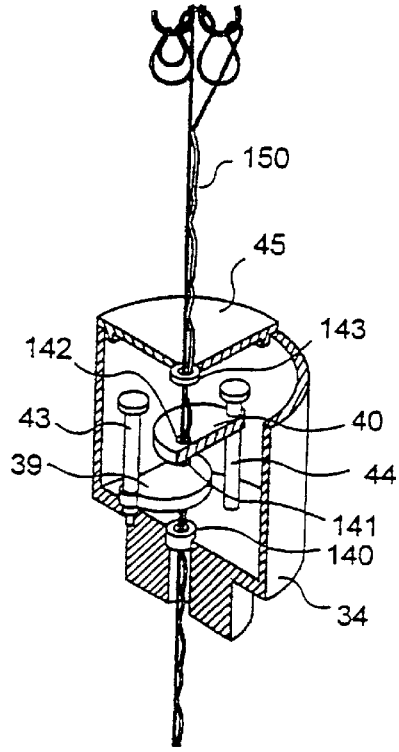
FIG. 7-b
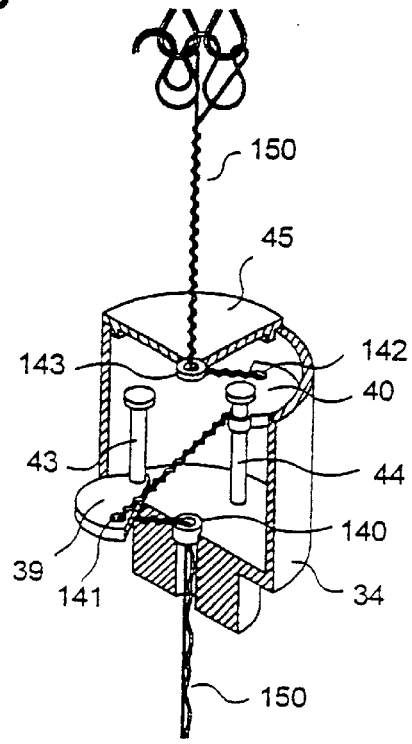

FIG. 8-a
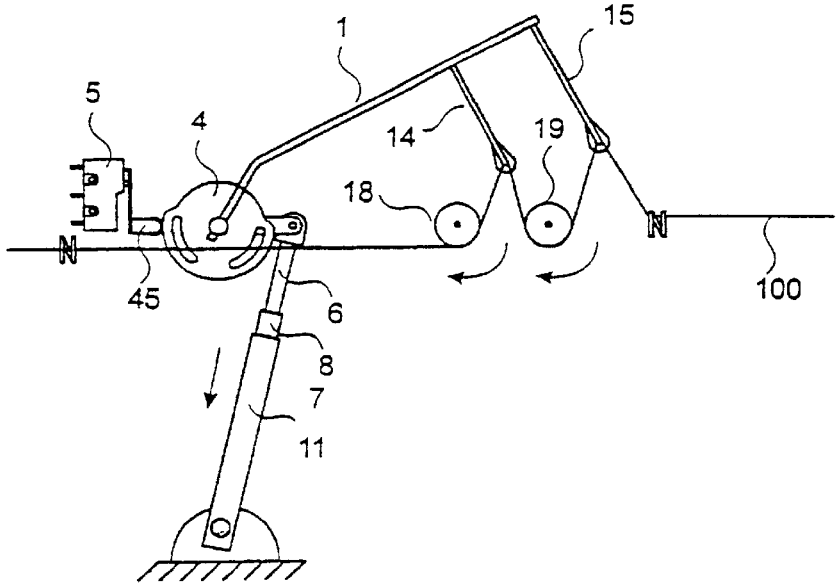
FIG. 8-b
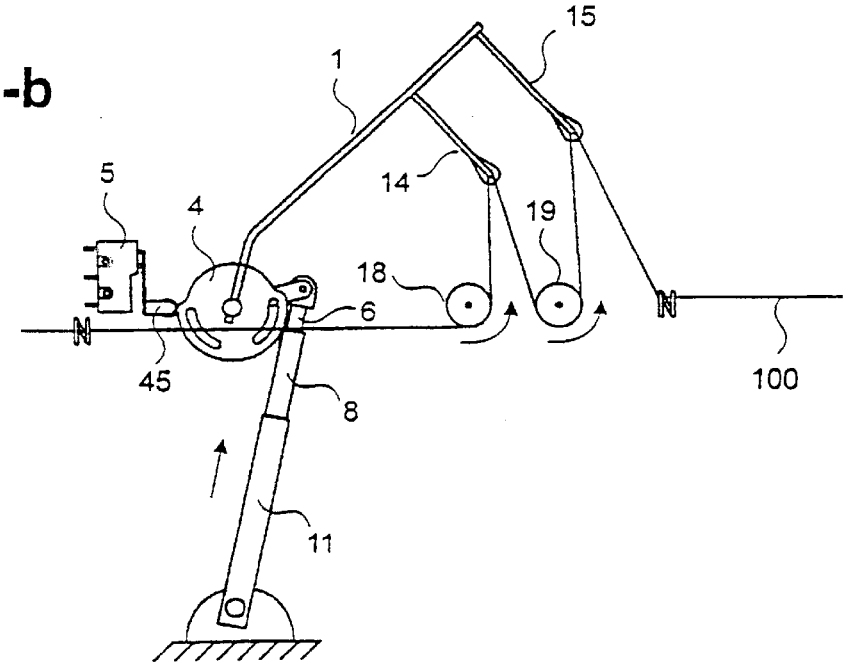

FIG. 8-c
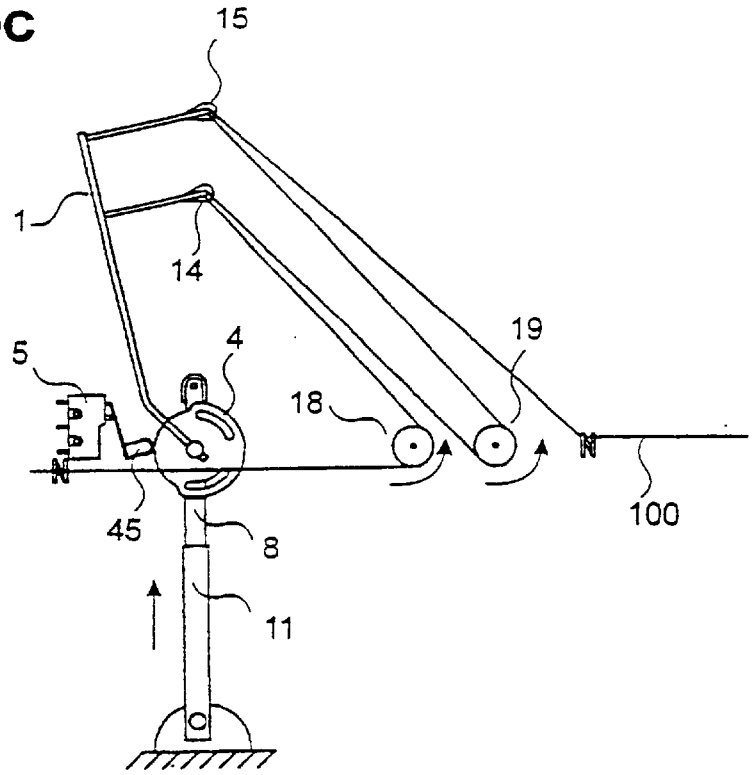
FIG 8-d
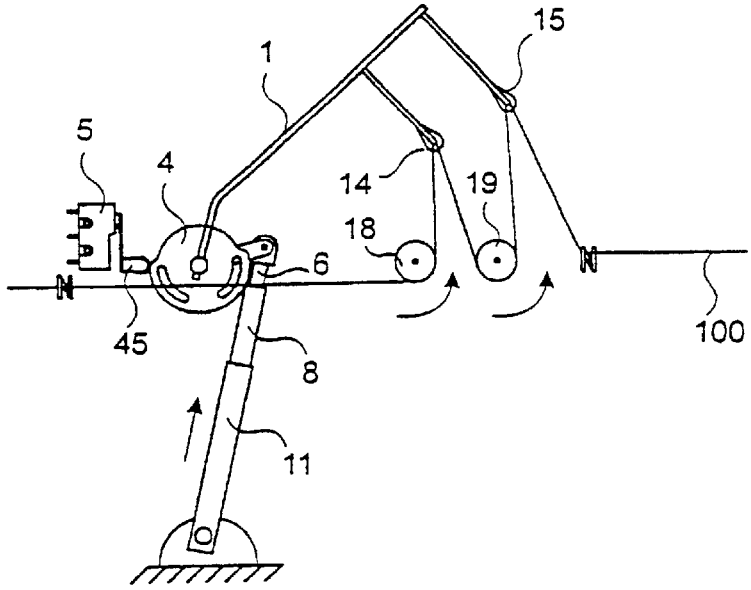

FIG. 9-a
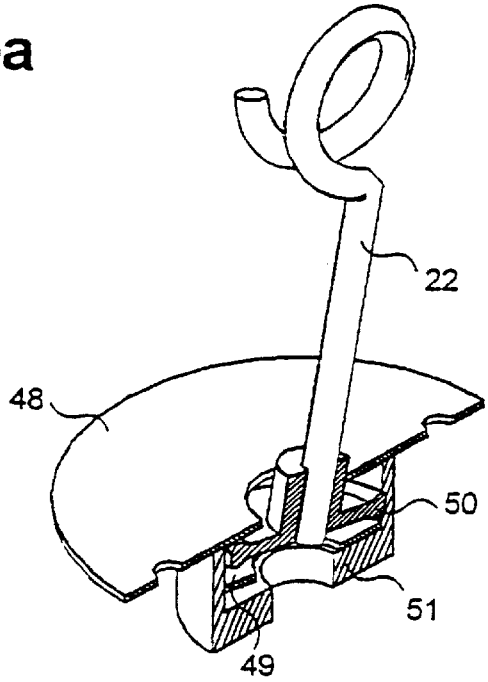
FIG. 9-b
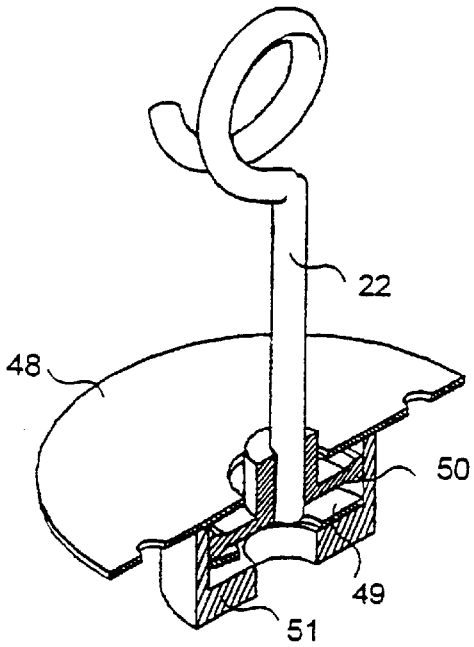

METHOD AND MACHINE FOR UNRAVELING KNITTED FABRICS

BACKGROUND OF THE INVENTION

1. Field of the Invention

The present invention relates to methods for unraveling knitted fabrics, the said methods providing that the unraveled yarns is brought into a reusable form by such a way that the knitting order of yarns of the knitted fabrics for knitwear production is determined automatically whatever the number of yarns in the knit is and the yarns are unraveled either by stretching and loosening according to the knit types or by twisting the yarns to each other, and relates to a machine for unraveling knitted fabrics, the said machine being operated by the said methods, characterized in that the said machine involves the desired numbers of units for unraveling knitted fabrics, thus it will be able to unravel the desired numbers of yarns and the desired numbers of various knitted fabrics together, and will be able to be controlled and used easily.

2. Description of Related Art

According to a method disclosed in U.S. Pat. No. 4,530,137, yarn ends are wound around pulleys connected to sliding clutches, which are actuated by the same shaft driven by a common motor, have a constant torque and are preset manually. The clutches, which are preset for promoting torque such that it can overcome the frictions in the knit in order to allow the yarn to be unraveled, provides that the unravelable yarns are wound around the said pulleys by rotating the pulleys. The stopped-up yarns remains stretched due to the torque on the said sliding clutches and the pulleys connected to the said yarns stops rotating, naturally at that time. In the case that all of the yarns are stopped up the system stops and the operator should eliminate the stoppage, manually. During the said operations, the stretched form of the yarns is maintained and any loosening operation is not carried out.

In the conventional machines marketed currently, the yarn ends are stretched by means of tension arms, the said tension arms maintaining the tension of the yarns by gravity due to their weights constant and/or by a spring where the yarns is pulled. After the unravelable yarns are attached to the said tension arm, they are connected to bobbin winders driven by their individual motor. Since the tension on the unravelable yarn is relatively less, the tension arm is in the open position and the yarn is winded to the bobbin by the operation of the electrical motor of the bobbin whereon the said yarn is connected, by means of an electrical switch connected to the said arm. At the moment when the yarn is stopped up, the reservoir arm comes to further closed position because of the increase in the yarn tension and by turning off the same electrical switch connected to the said arm, the current on the motor of the bobbin whereon the yarn is wound is cut off and with the use of an electromechanical brake or electrical brake applied to the motor directly, the bobbin is stopped so that the yarn breakage do not occur. Also in this method, the stopped-up yarns remain stretched and in the case that all of the yarns are stopped up, again the operator should eliminate the problem of stoppage of the yarns manually. During the said operations, tension of the yarns is maintained and any loosening operation is not carried out.

BRIEF SUMMARY OF THE INVENTION

The object of the present invention is to provide a method, wherein any fabric knitted with yarns is unraveled easily whatever the condition thereof is, for example how much plies exist in the yarn tuft, how many yarn tuft is used in knitting or how the said fabric is knitted, so that the yarns can be brought into the re-usable form and to provide a machine, comprising desired numbers of units for unraveling knitted fabrics, the said units being able to operate practically and easily in all conditions by using the methods for unraveling knitted fabrics, with the characteristics of tension-loosening and twisting of the yarns to each other if required, and being able to unravel the desired number of various knitted fabric or fabrics simultaneously without taking into account how many plies of yarn tuft and how many yarn tuft the knitted fabric has been knitted with, and having operational modes that can operate the units for unraveling knitted fabrics separately or the desired number of units together if necessary.

BRIEF DESCRIPTION OF THE SEVERAL VIEWS OF THE DRAWINGS

In order to achieve the object of the present invention, the machine for unraveling knitted fabrics wherein methods for unraveling knitted fabrics are used is illustrated in the accompanying drawing, in which:

FIG. 5*a* is a lateral sectional view on the A—A line of the machine for unraveling knitted fabrics, wherein the twisting claws (catches) are not in the opened position while the false twisting apparatus used for unraveling knitted fabrics with yarns of more than one ply operates with low speeds or is stable;

FIG. 5*b* is the plan view of the machine for unraveling knitted fabrics wherein the twisting claws are not in the opened position while the false twisting apparatus used for unraveling knitted fabrics with yarns of more than one ply operates with low speeds or is stable;

FIG. 6*a* is a lateral sectional view on the A—A line of the machine for unraveling knitted fabrics wherein the twisting claws are in the opened position while the false twisting apparatus used for unraveling knitted fabrics with yarns of more than one ply operates with high speeds;

FIG. 6*b* is the plan view of the machine for unraveling knitted fabrics wherein the twisting claws are in the opened position while the false twisting apparatus used for unraveling knitted fabrics with yarns of more than one ply operates with high speeds;

FIG. 7*a* is a schematic view of the machine for unraveling knitted fabrics at the normal state wherein the twisting claws are not in the opened position while the false twisting apparatus used for unraveling knitted fabrics with yarns of more than one ply operates with low speeds or is stable;

FIG. 7*b* is a schematic view of the machine for unraveling knitted fabrics wherein the twisting claws are in the opened position while the false twisting apparatus used for unraveling knitted fabrics with yarns of more than one ply operates with high speeds and the yarns are twisted by the rotation performed;

FIG. 8*a* is a view of the machine for unraveling knitted fabrics at the moment when the yarn in a single unraveling unit has been loosen;

FIG. 8*b* is a view of the machine for unraveling knitted fabrics at the moment when the case of unraveling of the yarn in a single unraveling unit by stretching is tested;

FIG. 8*c* is a view of the machine for unraveling knitted fabrics wherein the yarn in a single unraveling unit is pulled by a winding unit, to be unraveled and winded;

FIG. 8*d* is a view of the machine for unraveling knitted fabrics at the moment when the yarn in a single unraveling unit is stopped up during the unraveling operation;

FIG. 9*a* is a sectional view of the case that the yarn attached to a mechanical Yarn tension sensor passage completes the circuit when it is in stretched form;

FIG. 9*b* is a sectional view of the case that the circuit is kept in open position in the condition that the yarn attached to a mechanical yarn tension sensor passage is not in stretched form;

Figure 1:
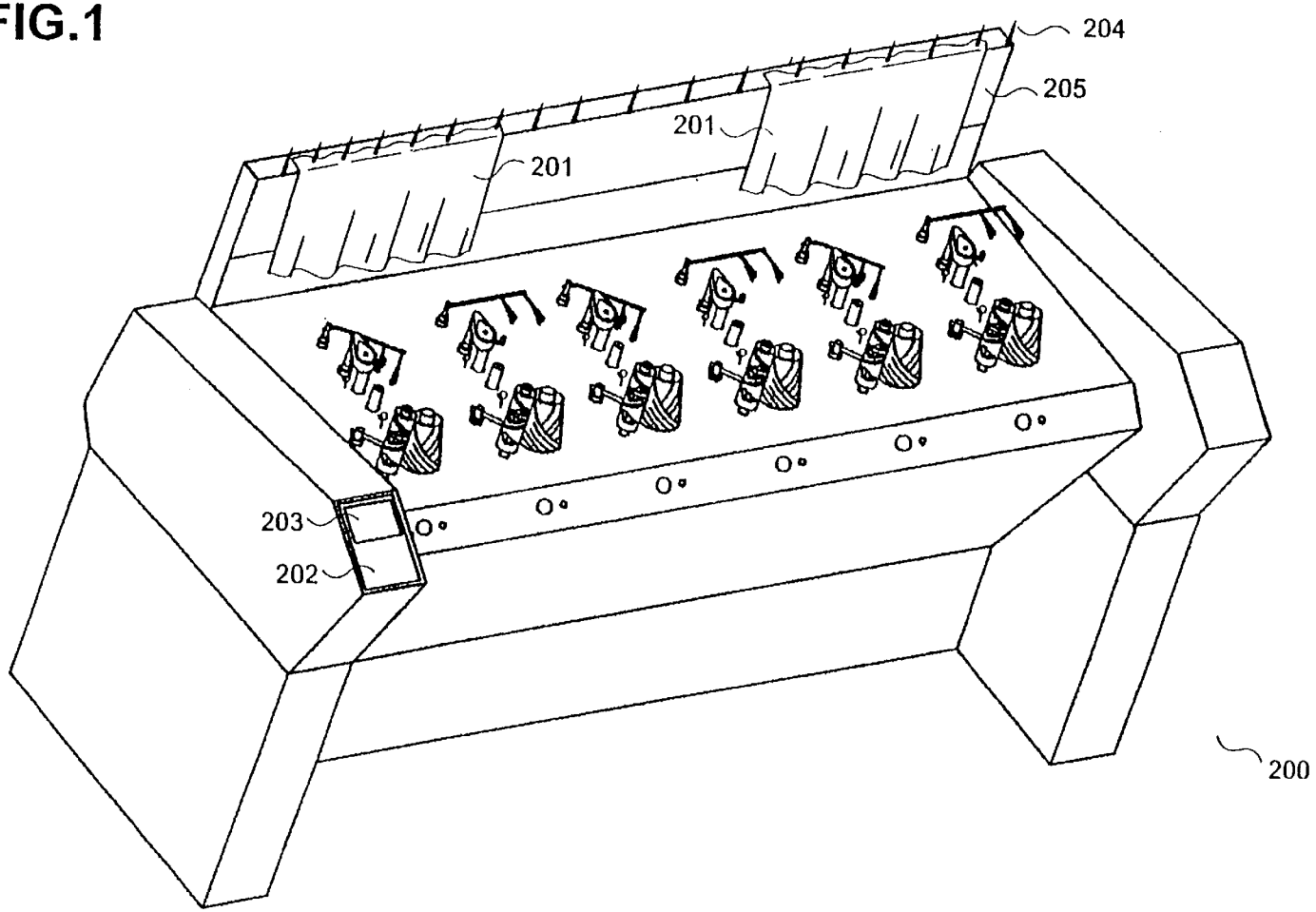
FIG. 1 is a three-dimensional general schematic view of the machine for unraveling knitted fabrics with six unraveling units.

The numbers corresponding the members in the figures are indicated in the following:

(1) Tension/reservoir arm (optionally stretchable)
(2) Tension/reservoir arm shaft
(3) Crank arm
(4) Electrical switch cam
(5) Electrical switch
(6) Piston arm
(7) Piston
(8) Rigid piston spring
(9) Piston tube spring
(10) Fluid input
(11) Actuator body
(12) Fixed support
(13) Chassis plate
(14) First yarn guide passage of the arm
(15) Second yarn guide passage of the arm
(16) False (artificial) twisting apparatus
(17) Yarn support
(18) First yarn feeder
(19) Second yarn feeder
(20) Belt
(21) First fixed yarn guide passage
(22) Passage with movable cover
(23) Yarn bobbin
(24) Yarn bobbin arm
(25) Movable joint
(26) Yarn winding drum
(27) Yarn winding drum shaft
(28) Yarn winding drum motor
(29) Fixed support of the yarn winding mechanism
(30) Spring of the yarn winding mechanism
(31) Crank arm of the yarn winding mechanism
(32) Yarn-tension sensor
(33) Yarn-feeders motor
(34) Revolute Joint housing
(35) Rubber surface actuated by the first yarn feeder
(36) Anti-friction bearing
(37) Upper yarn feeder input guide passage of false twisting apparatus
(38) Lower yarn feeder output guide passage of false twisting apparatus
(39) Claw, with hollow middle part at the bottom, of false twisting apparatus
(40) Claw, with hollow middle part at the top, of false twisting apparatus
(41) Spring, holding the claw with hollow middle part at the bottom, of false twisting apparatus
(42) Spring, holding the claw with hollow middle part at the top, of false twisting apparatus
(43) Shaft attaching the claw, with hollow middle part at the bottom, to the base of the false twisting apparatus
(44) Shaft attaching the claw, with hollow middle part at the top, to the base of the false twisting apparatus
(45) Revolute Joint
(46) Fixed top cover of the yarn twisting mechanism
(47) Joint connecting the piston arm to the crank arm
(48) Movable top plate the passage
(49) Movable bottom contact plate of the passage
(50) Movable contact ring of the passage
(51) Movable collecting box of the passage
(100) Model yarn for illustration
(101) Unraveled yarn end
(102) Unraveled yarn end
(103) Unraveled yarn end
(104) First unraveled loop of the yarn (101)
(105) Yarn (102) loop contained within the first loop at the end of the knitted fabric to be unraveled of the other yarn (101)
(106) First yarn (102) loop to be unraveled
(107) Yarn (103) loop contained within the first loop to be unraveled of the other yarn (102)
(108) First yarn (103) loop to be unraveled
(109) Yarn (101) loop contained within the first yarn, (103) loop to be unraveled other than the loops in the upper order, which is not unraveled
(110) First yarn (103) loop tangled since it can not be unraveled
(111) Second yarn (103) loop tangled since it can not be unraveled
(112) Second yarn (102) loop in the second order which is not unraveled
(113) First yarn (102) loop in the second order which is not unraveled (114) Second yarn (101) loop in the second order which is not unraveled
(115) First yarn (101) loop in the second order which is not unraveled
(140) Fixed final yarn guide passage of the first unit for unraveling knitted fabrics
(141) Third yarn guide passage of the first unit for unraveling knitted fabrics
(142) Second yarn guide passage of the first unit for unraveling knitted fabrics
(143) First yarn guide passage of the first unit for unraveling knitted fabrics
(144) Fixed final yarn guide passage of the second unit for unraveling knitted fabrics
(150) Unraveled yarn end with two plies
(151) Yarn end unraveled
(152) Yarn end unraveled
(153) First yarn (151) loop to be unraveled
(154) Second yarn (151) loop to be unraveled
(155) Third yarn (151) loop to be unraveled
(156) First loop contained within the third unraveled yarn (151) loop to be unraveled, on the side of an upper knitting order which has been not unraveled, where the yarns (151, 152) are knitted together
(157) Second loop contained within the second unraveled yarn (151) loop to be unraveled, on the side of an upper knitting order which has been not unraveled, where the yarns (151, 152) are knitted together
(158) Third loop contained within the first unraveled yarn (115) loop to be unraveled on the side of the upper knitting order which has been not unraveled, where the yarns (151, 152) are knitted together
(159) Knitted loop with two plies
(170) Unraveled model yarn, used in knitting with two plies
(171) Unraveled model yarn, used in knitting with two plies
(172) Unraveled model yarn, used in knitting with single ply
(200) Machine for unraveling knitted fabrics with more than one unraveling unit
(201) Unraveled knitted fabric
(202) Control panel
(203) Indicator table
(204) Pins for hanging knitted fabrics
(205) Hanger surface
(206) Control button
(207) Warning lamp

DETAILED DESCRIPTION OF THE INVENTION

When there is a necessity for unraveling the knitted fabrics, the said knitted fabrics being formed such that the yarn or yarns is/are guided through the loops in a particular arrangement, the unraveling operation is not carried out as easily as the knitting operation since, according to the knitting types, it is not sufficient to keep the yarns stretched by pulling them continuously and then the determination of the unraveling order of the yarns, and unraveling times and elimination of the tangle of the yarns becomes necessary. While testing to eliminate the said problems, it should be paid attention not to form the yarn breakage's.

All of the problems mentioned above are solved by the stretching-loosening characteristics constituting the base of the method for unraveling knitted fabrics according to the present invention and by a machine for unraveling knitted fabrics operated by the said methods, and can be applied. In all stages of the unraveling operation, if necessary the yarns of the knitted fabric is stretched or loosened. If necessary, they are twisted onto each other.

The machine for unraveling knitted fabrics according to the invention consists of more than one unit for unraveling knitted fabrics. The increase in the number of the said units provides that more than one knitted fabric can be unraveled simultaneously and the knitted fabric with multi-yarns can be unraveled. Each of the units for unraveling knitted fabrics comprises three basic parts and passages. The said parts are tension/reservoir arm, winding unit, and sensors. Also yarn feeders, twisting mechanisms, and parts acting as a spring are included in the said units. The yarns are actuated individually or all together by means of the winding unit, yarn feeders or parts acting as a spring.

The unraveling operation according to the invention is started first by connecting the yarn or yarns of knitted fabric to the different unraveling units of the machine arbitrarily, whether or not the yarns to be unraveled has been unraveled by stretching and then loosening them individually is determined and the unraveling order and the case whether or not the they have been unraveled is recorded. After unraveling the yarns individually, the yarns, which can not be unraveled and are stopped up thereafter, are tested by stretching and loosening if required, until they are unraveled according to the order recorded. Except for emergency requirements, sensors are used to detect that the tension in the yarn exceeds the tension necessary not to break the stretched yarn, therefrom it is understood that the yarn is stopped up and then it is loosened.

During unraveling of the knitted fabric, when the tension on the yarns stopped up at the end of the knitted fabric or within the knitted fabric due to some reasons is high and/or is maintained, the loops forming the continuation of the said yarn get smaller because of the tension whereon and then make the other loops where the yarn is connected tangled. The tangled loops resulted from the said tension prevents the other loops from being unraveled and they form a kind of entanglement. Stretching the yarns in order to eliminate the said entanglement may cause some breakage in the yarns. Although the entanglement is eliminated and then loops can be unraveled by means of high tension applicable to relatively strong yarns, mostly it may not be possible to achieve this. The high tension applied to the yarns in order to eliminate the said entanglement and then to unravel the loop, it increase the tangle of the yarn and it may cause the yarn to break. The lower tension applied such that it will not cause the said tangle becomes mostly insufficient to overcome the friction force required to unravel the loops being not tangled so that they can be unraveled normally, therefore the unraveling operation can not be carried out.

Figure 10:
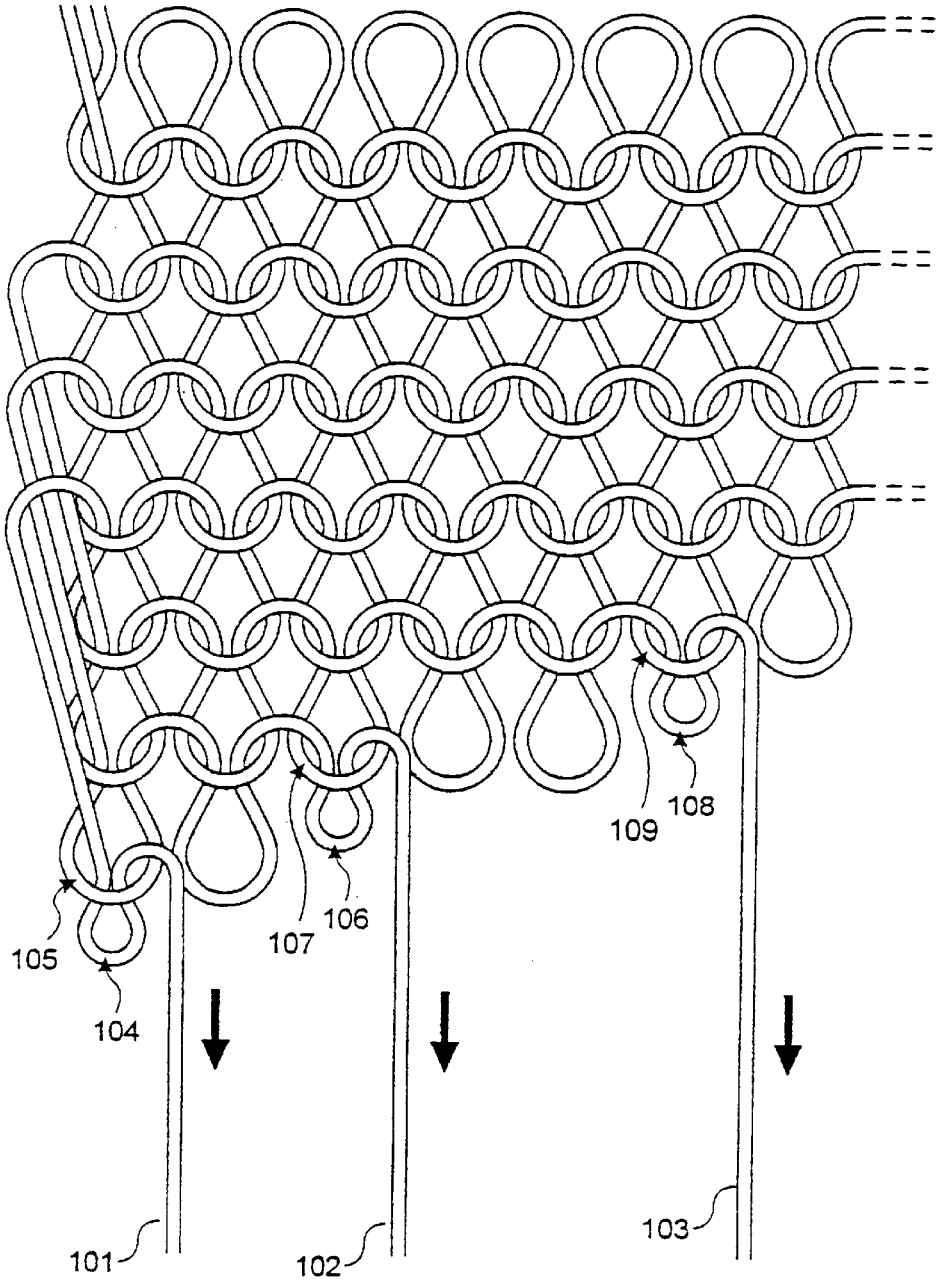
FIG. 10 is a schematic view of the unraveling order of a kind of fabric knitted by three different yarns, each of which has one ply.
Figure 11:
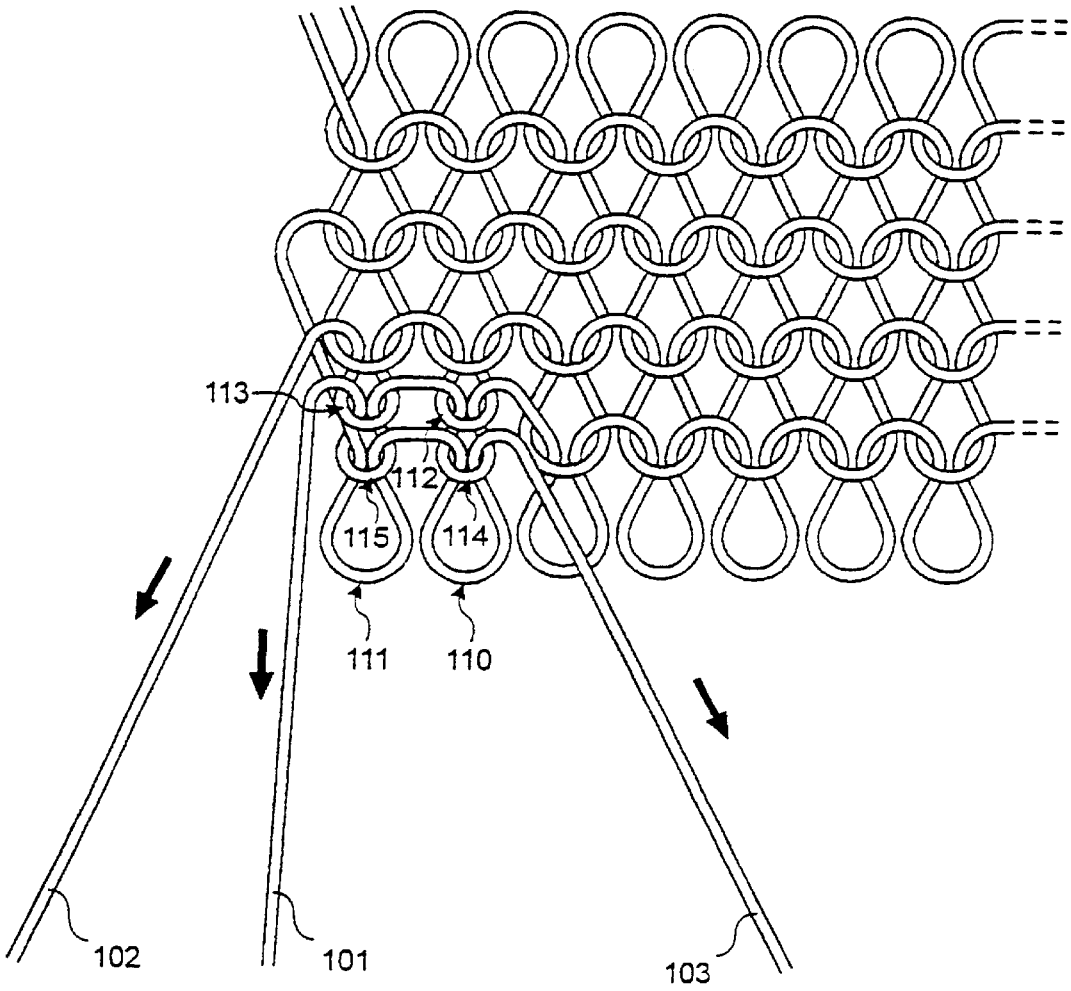
FIG. 11 is a schematic view of entanglement in the unraveling order of a kind of fabric knitted by three different yarns, each of which has one ply.

The said problem was exemplified by a single knitted jersey fabric formed by three yarn with single ply and order (FIG. 10). The problem is identical in double jersey or other knit types. In this example, the knit is unraveled by pulling the yarn ends (101, 102, and 103). The case wherein two of the said unraveled (101, 102) are stopped up when they reach to the knit end is illustrated in another example (FIG. 11). Because the loops (114, 115) being the continuation of one of the yarns (101) and the loops (112, 113) being the continuation of another yarn (102) get smaller, due to the tension on the yarns (101, 102), the said tangle occurs (FIG. 11). The case where the said loops (112, 113) getting smaller make the other loops (110, 111). Within the said loops tangled (FIG. 11). Although there is a normal tension on the yarn (103) except for the yarns stretched because of the said reason, the loops (110, 11) being the continuation of the said yarn (103) can not be unraveled due to this tangle (FIG. 11).

As described in the said example, the tension on the unraveled yarns is eliminated by unraveling by means of the method according to the present invention. In this method the tension on the unravelable yarn or yarns is maintained, the yarns being stopped up due to any reason while unraveling operation are loosened by eliminating their tension and the said stopped-up yarns are stretched again at a time if required and in required orders. This operation can be carried out at an instant when one of the unraveled yarns is stopped up or when it is understood that they are stopped up after they are tested or at an instant when all of the yarns are stopped up or immediately after these events. Such stoppages are diminished or terminated also by the use of the machine according to the invention automatically or by means of mechanisms making the stopped-up yarn both stretched and non-stretched according to the command coming from a control unit.

Figure 12:
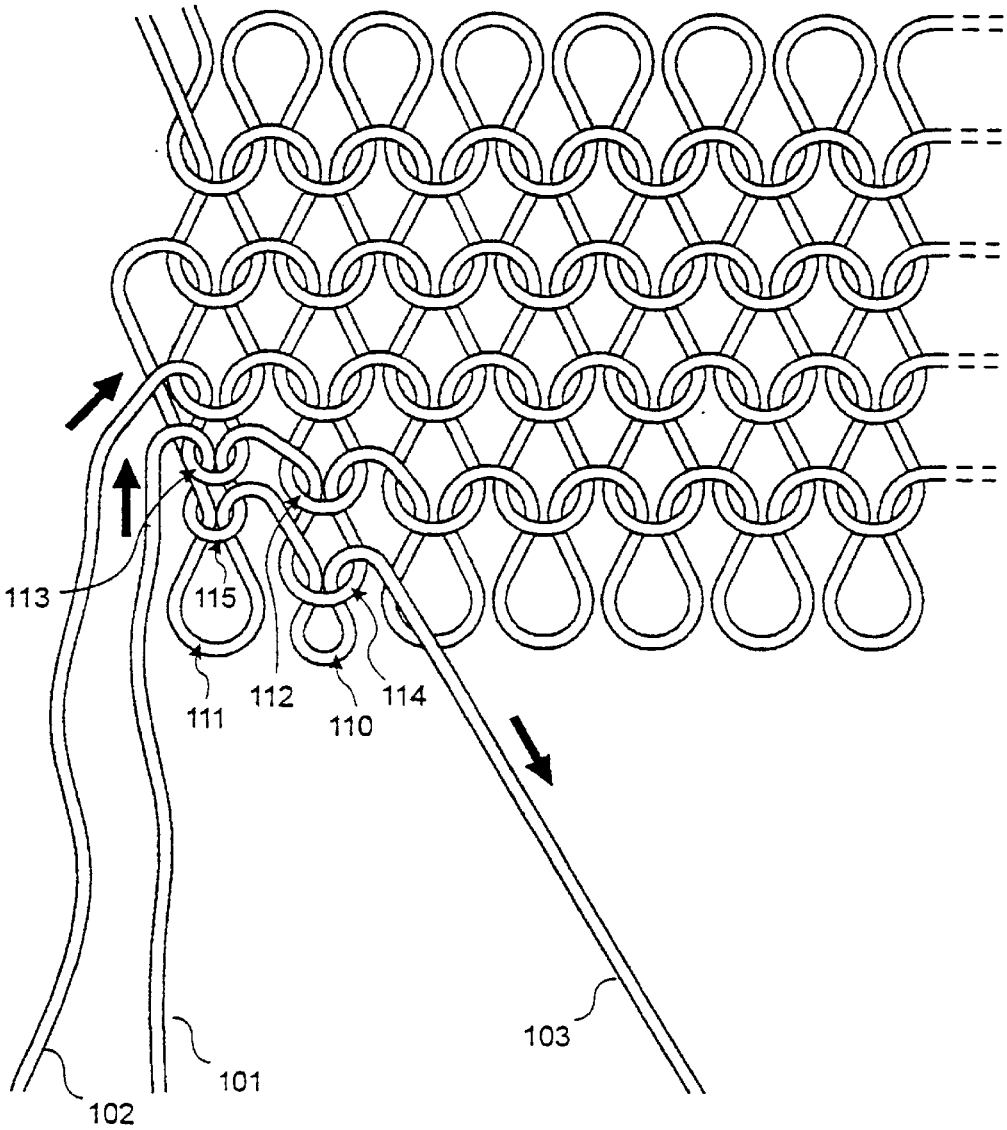
FIG. 12 is a schematic view of the cases of stretching and loosening of the yarns in order to solve tangles in the unraveling order of a kind of fabric knitted by three different yarns, each of which have one ply.

This method cam prevent the loops constituting the continuation of the stopped-up yarns from getting smaller, to some extent. Even if the loops has get smaller due to the inertia of the tension mechanisms or sudden tension caused by the stoppage, and they has tangled the yarns required to be unraveled, they can be unraveled; because the loop getting smaller due to the tension on the yarns being continuation of the loops required to be unraveled and a force exerted on the loop getting smaller can get larger by using a loosened yarn being its respective continuation of it. Therefore, it is provided that the loop following the order can be unraveled (FIG. 12). Also in the same method, loosening of other yarns at the end of the knit, the said yarns having completed the knitting order and being in stretched form, becomes helpful in receiving the yarn, which is required so that the loops getting smaller get larger, from the yarn being its own continuation. The elimination of the stoppage described in the previous example is illustrated in another figure (FIG. 12). It is seen that the loops (110, 111), the said loops preventing the loops (112, 113) getting smaller due to the tension of one of the stopped-up yarns (102) in this example from being tangled and then being unraveled, get larger by taking the yarn from the loop (113) being own continuation of the loop (112) get smaller previously (FIG. 11) by the help of a force, the said force forming the tension on the yarn (103) being the continuation of the said loops (110, 111) (FIG. 12). Also the loop (113) through which tire yarn is taken takes some yarns from the own continuation of the loosened yarn (102) and so the tension thereon is diminished (FIG. 12). As a result of that this loosened loop (112) of the yarn (102) get larger, the first loop (110) of the other yarn tangled within this loop following the order can be unraveled easily (FIG. 12). Since the force, which forms tension of this yarn (103) stopped up on the loop (112) of the other yarn (102) that tangles it, is sensed on the another loop (114) of an other yarn (101) that also tangles this yarn, it is necessary that firstly the yarn (101) is loosened and so an further yarn to eliminate the tangle is provided. Providing that the yarn is loosened to supply also farther yarn to the other yarn (102) tangled by the loops (114, 115) of this yarn loosened in the same manner, also tangled loops (111, 113) of this yarn is allowed to loosen and get larger. Hence it is provided that the loops (110, 111) of the third yarn (103) tangled by them, the loops (110, 11) tangled by providing the tension of this yarn (103) of all of these tangled loops, (112, 113, 114, 115) become free. The loosening operation can be carried out automatically at the instant when the yarns are stopped up and it is performed also after the yarns are stopped up or at an instant when all of the yarns are stopped up, depending on the type of the knit and the yarn.

After the yarns forming the unraveled fabric or the yarn ends are loosened by the use of the method for unraveling knitted fabrics according to the present invention, the tension the am intended to be unraveled or the yarn or yarns tested in respect to their unravelability should be changeable in order to continue to unravel these yarns. This is provided by a mechanism which can give and remove tension automatically in any way and by the machine for unraveling knitted fabrics according to the present invention wherein parts comprising the said mechanism are directed by a program.

According to the commands given by a control unit, this operation wherein the mechanism is operated is carried out according to a predetermined or moment-produced order in any way wherein the said order are determined by this control unit or manually, the said control unit being developed in accordance with a program which evaluates and then predicts the unraveling order of the yarns attached on the units for unraveling knitted fabrics arbitrarily according to the position of the said unit wherein the yarns are attached, after the yarns are tested by stretching and loosening.

Figure 3:
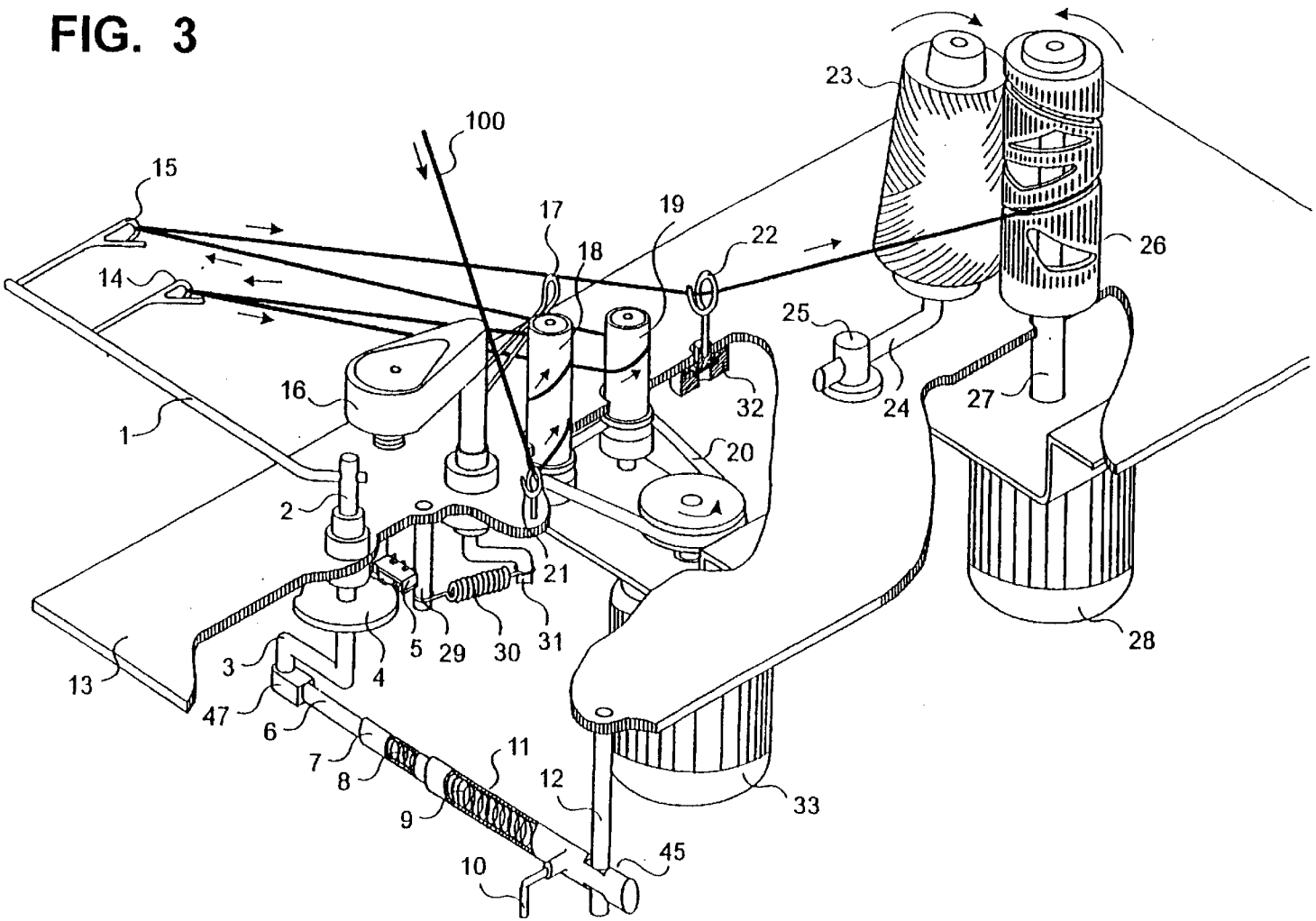
FIG. 3 is three-dimensional view of a single unraveling unit of the machine for unraveling knitted fabrics, the parts of the said unit and the way followed by the yarn guided through the said unit.

During these operations, it is necessary to stop immediately the bobbin whereon the yarn is winded after the yarn is stopped up. Otherwise, the stretched yarn can break. Actually, it is impossible to stop this winding of the bobbin at the instant when the yarn is stopped up in real atmosphere since the bobbin and the motor driving the said bobbin has an inertia. For the said reason, some yarn should be supplied to the bobbin so that the breakage of the yarn do not occur until the bobbin (23) stops completely. This operation is provided by means of a reservoir system supplying yarns, in the machine (FIG. 3). The said system consists of a tension/reservoir arm (1), the yarn guide passages (14, 15) on the said arm, an electrical switch cam (4) whereon the tension/reservoir arm (1) is connected, an electrical switch (5), the said switch (5) being controlled such that it is turned on and off by the form of said cam, yarn feeders (18, 19), a fixed yarn guide passages (22) with movable cover, a yarn tension sensor (32), the said sensor providing that the operation stops after sensing the tension whereon the passage is attached, being contacted by the fixed passage with movable cover at the instant of tension, and providing that a warning command for required tension is given, and a programmed electrical control unit, the said control unit controlling the commands taken from the sensor and then giving other necessary commands to the system. Tension/reservoir arm (1), yarn guide passages (14, 15) on this arm, yarn feeders (18, 19) supplies the required yarn at the instant of tangling of the yarn guided through the fixed yarn guide passage (22) with movable cover. The tension/reservoir arm (1) approaches the yarn feeders (18, 19) by turning around a shaft (2) in the case of tension of the yarn and then the tension in the yarn increases as the yarn reserve in the reservoir on this position diminishes. An electrical switch or an electronic sensor connected to a chassis fixedly is stimulated by the form of the cam (4) whereon the arm (1) is attached as soon as the angle of the arm (1) reaches a particular position because there will be a change in the location due to the increase in the tension on the tension/reservoir arm (1) when the yarns are stopped up (FIG. 8-*d*). Hence, that the yarn has a particular tension is disclosed to the controller.

When the tension/reservoir arm is active under tension, the pushing and pulling movement provide by a linear actuator (6, 7, 11) comprising preferably mechanical springs (8, 9). But this functions can be provided easily also by means of actuators driven by pneumatic, hydraulic or electrical current. Due to the angular mobility of the cam, also an angular actuator may be used instead of a linear actuator.

Preferably a spring (8) is placed between the said actuator and the tension arm, the said spring having the functions wherein it softens the effect of the sudden movement of the tension/reservoir arm on the yarn and it compensates the sudden tension changes on the yarn. The mechanical softening spring (8) can be also a hydraulic, pneumatic damper, according to the its position and the use conditions of the machine. The amount of the tension on the arm (1) is provided by altering the force of the actuator altering the lengths of the moment arms in the system, altering its tension at the beginning and using springs with different features.

The actuator which is preferably pneumatic and comprises parts (7, 11) connected to a rotating bearing (45) pushes a spring (8), the said rotating around a fixed support (12), then the said spring pushes the rocker arm (6) guided by a portion (7) which is contained within the spring and this arm conducts its force to the crank (3) and the tension/reservoir arm (1) becomes stretched. The amount of the pressure within the pneumatic actuator determines the amount of the tension force directly on the tension/reservoir arm.

When the force exerted by the actuator is eliminated, the tension on the arm will be removed. Hence the excess hanging that may occur in the reserve yarn between the yarn feeders of the passages (14, 15) on the arm (1) and the first and fixed yarn feeders with movable cover is provided by means of a relatively softer fixed spring (9) by pushing the arm backward slightly such that it will not exert high tension.

Yarn feeders (18, 19) and yarn winding drum (26) allow the yarn to be actuated. The yarn feeders (18, 19) can be actuated in two direction preferably by means of a single motor (33) since it is found economical with use of a common belt (20) and also can operate easily. In the cases when the arm (1) is closed since the amount of yarn diminishes in the reservoir, the yarn feeding cylinders (18, 19) can rotate in reverse direction, opposite to the normal winding direction in order to loosen the stopped-up yarn. The yarn winding drum (26) is actuated by a motor (28) with adjustable speed and with a mechanical or electrical brake system, by the aid of a movable shaft (27). In the cases when the tension on the arm (1) increases as the yarns are stopped up, the amount of the yarns in the reservoir decreases. In this case, the extra yarn in the reservoir passes to the yarn section on the fabric side in stretched form and then loosens the yarn, by rotation of the yarn feeding cylinders (18, 19) in reverse direction (FIG. 8-*a*). Hence all of the functions consisting of the application to tension to the yarn which is unraveled such that it can adjusted according to the characteristics of the yarn and knit, the removal of the tension therefrom, and acting also as a reservoir are carried out by means of a integrated system.

In the cases when an active actuator are not used, the stretched form of the tension/reservoir arm (1) is maintained by a constant force and by means of a spring (9), the said spring being connected onto the said arm and being fixed but more rigid than the one in the previous method. Also in this case, since the tension decreases as the reservoir amount increases, the tension, to be intended to decrease, of the yarn which is not unraveled is provided such that the bobbin (23) wherein the yarn is wounded thereon and actuated by means of a yarn winding drum (26) wherein a motor (28) is connected thereto, the said motor rotating in both two direction according to a command and having ability to brake, rotates slightly and then supplies yarns to the reservoir and therefore the force on the tension/reservoir arm (1) is decreased. When it is desired to give a tension to this yarn, the bobbin (23) is turned in the direction of winding slightly and then the amount of yarn in the reservoir is pulled and is decreased thereby. So the tension on the tension/reservoir arm (1) and so on the yarn increases.

Figure 2:
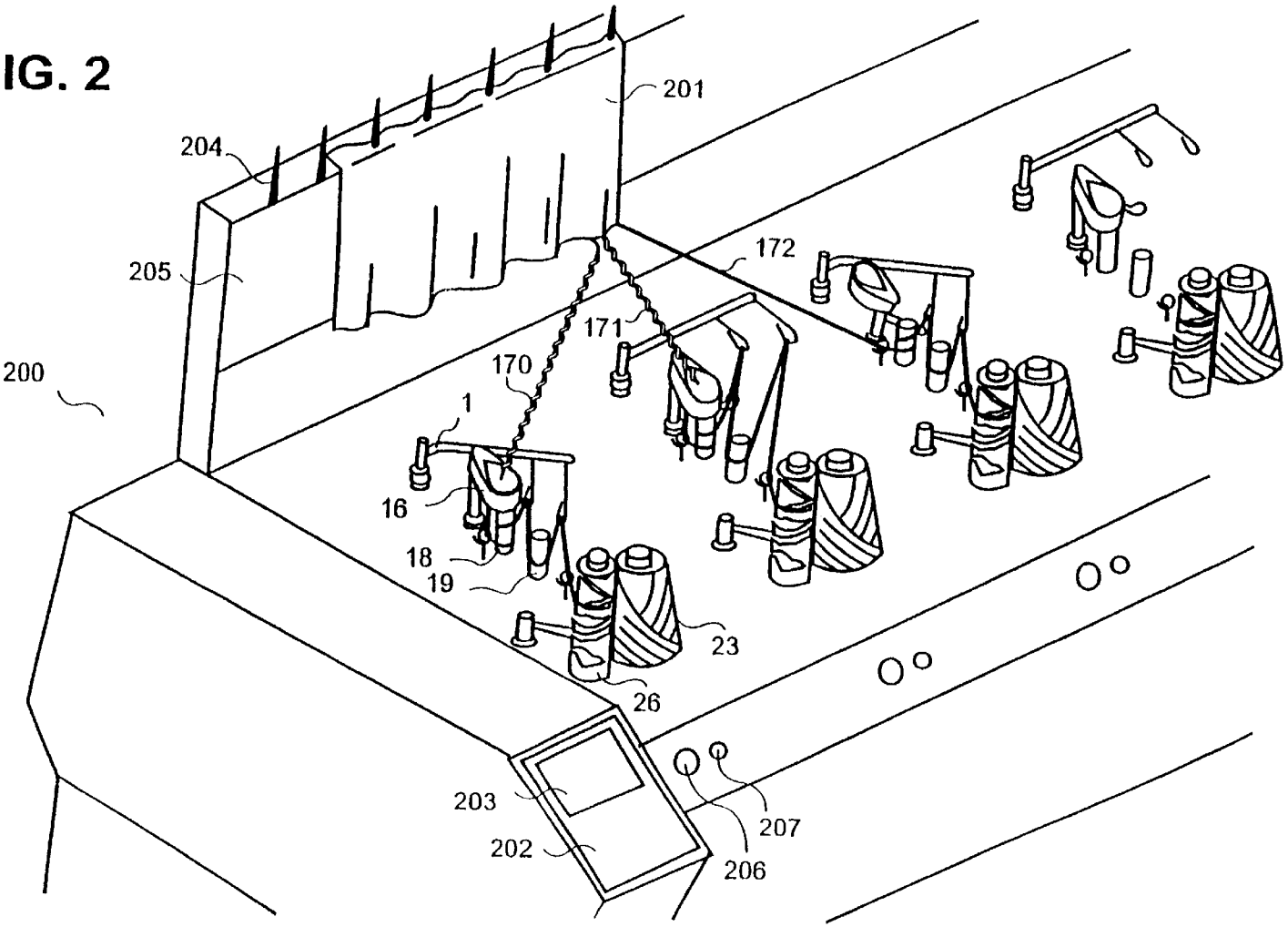
FIG. 2 is a three-dimensional schematic view wherein in the two of the three unraveling units of the machine for unraveling knitted fabrics, with muiti-unraveling units, during unraveling of a fabric knitted by two yarns with double plies and one yarn with a single ply, two yarns are unraveled together via twisting operation and the single yarn is unraveled normally.

The yarn (100) is guided through the fixed yarn guide passages (21, 22) with a movable cover and the passages (14, 15) above tension/reservoir arm (1), for one or more than one time so that the said arm can store the yarns of more amounts and in a smaller space, onto the latter (FIG. 2). So the reserved yarn amount increases and the tensions can be controlled easily. Also the tension on the yarn becomes decreased when the yarns, which are guided through the passages, enters and exits the passages. Hence the impact force exerted on the yarn becomes decreased since the tension/reservoir arm (1) are stretched and loosened suddenly. Although the increase in the number of the passages appears to be as an advantage, there exist some disadvantages such that some frictions that can be formed in the passages, it is difficult to use the machine for workers who operate it, moment of inertia increases due to the location of great numbers of passages. For the said reasons, the optimum number should be determined depending on the usage. Preferably, two passages (14, 15) are used above the tension/reservoir arm (1) of the said machine for unraveling knitted fabrics. Preferably, the said passages are supported by the use of two yarn feeders (18, 19), one first fixed input passage (21), and one fixed passage (22) with movable cover.

While the unraveling operation is carried out or the test in respect to unravelability of the yarn is performed, or in the case when the yarn is loosened, the frictions between the yarn and the yarn guide passages leads to negative tension differences such that it increases in the direction of the yarn flow in different regions on the yarn. The yarn end in the winding region is more stretched than the end in the unraveling region (FIG. 2). The tension, which is given to the arm in order to provide that the unraveling side is stretched to a particular level for unraveling the yarn, cause yarn breakage's in the winding side. When it is necessary to loosen the stopped-up yarn, in spite of the tension on the arm, which is dropped in order to loosen the yarn, the frictions in the yarn guide passages prevents the tension of the yarn in the unraveled fabric side from decreasing to a value below a particular level.

In order to reduce the tension differences formed due to the frictions in the yarn guide passages to minimum value, cylinders with slippery surface (yarn feeders(18, 19)) are placed to one or more than one passage wherein the yarn is guided, the said cylinders rotating in both two direction preferably by means of a single electrical motor, according to a command. The tension differences, formed due to the friction on the passages by guiding and winding the yarn around the said yarn feeders (18, 19) have been minimized and also it has been helped the yarn to be pulled for unraveling. While the unraveling operation is carried out or the test in respect to unravelability of the yarn is performed, the yarn feeders rotates in the direction of yarn flow and with a surface velocity which is faster than the possible velocity of the yarn. Meanwhile, the friction between the yarn and the yarn feeders effects the system advantageously. Hence the elimination of the breakage problem occurring since the yarn is pulled and undesired tension is formed on the yarn is provided. In addition, it provides that the high tension on the yarn at the unraveled knitted fabric side is maintained and the tension of the yarn at the winding side is reduced.

When it is desired to reduce the tension on the unraveled yarn, the said yarn feeding cylinders (18, 19) starts rotating backwards by removing the tension on the arm. However, since it is desired to terminate the tension only due to the friction of the yarn which is stationary during the backward rotation it is sufficient to perform backward rotation with too low speeds. The excess tension, which exist at the unraveled knitted fabric side and should be removed therefrom, is eliminated by this method.

When the yarn amount in the reservoir decreases, the arm (1) takes the more closed position and this situation is conducted to an electrical switch (5) by means of a cam (4) connected to the actuator taking passive condition (FIG. 8-*d*). So the yarn loosening operation is started and the yarn feeding cylinders (8, 19) rotates in reverse direction (FIG. 8-*a*).

The test in respect to unravelability of the yarn is performed as described in the following (FIG. 8-*b*): The actuator (11) becomes active and yarn feeding cylinders (18, 19) begins to rotate forwardly. When the unraveling operation is not performed, it is continued to keep the arm (1) in the closed position since the amount of yarn in the reservoir is not sufficient. By means of an electrical switch (5) which is closed by the cam (4) connected to the arm (1), the controller is informed about that the arm (1) is closed (FIG. 8-*b*). In the case that the yarn can be unraveled, the arm is opened, so the cam (4) moves and the electrical switch (5) is opened by means of the form of the cam (4) and the case of stretching and loosening of yarn is conducted to the user (FIG. 8-*c*). In this case, the actuator be becomes active and the yarn feeding cylinders (18, 19) rotates forwardly.

In the cases of that some stoppage may occur after the yarn is stretched and the unraveling operation is started, the same motions are repeated. In these cases, the actuator (11) is still active, the yarn feeding cylinders (18, 19) rotates forwardly (FIG. 8-*d*). But the tension on the arm (1) increases since the amount of the yarn in the reservoir reaches to a value less than that is required, so this case is conducted to the controller by the aid of the electrical sensor (5) which the cam (4) turns off, the said cam being connected to the arm (1) (FIG. 8-*d*). Here, the motor (28) which is connected to the winding drum (26) having function of yarn windings is braked immediately directly by a warning sent from the electrical switch or by the controller (FIG. 3). Also the bobbin (26) stops immediately due to the friction between the bobbin (23) and winding drum (26). Therefore it is provided that the yarn (100) stops immediately without breaking, the said yarn is winded to the bobbin (26) after being unraveled. Because the winding drum stops and continue to rotate frequently, its inertia should be little and so it is made up of a light metal and in a form of a cylinder, inside which is hollow and on which there exist some slots such that uniform yarn winding on the bobbin is carried out by directing the said yarn. The bobbin surface is rough so that it can rotate the bobbin and then make it stopped, easily.

In the one of the passages (21) wherein the yarn is guided, there exist a tension sensor (32) which is preferably a mechanical switch and will sense the breakage of the yarn. This electronically-controlled switch can sense the presence of the yarn during yarn unraveling operation and during the test in respect to the yarn tension easily since it is a fixed passage with movable cover, the said switch being also used as a passage.

The machine for unraveling knitted fabrics according to the present invention can unravel the knit with different kinds of choices by using the method for loosening and stretching the yarn in different ways. In a mode, the said mode being one of those mentioned and being defined as ordering mode in the machine, all of the yarns exist in stretched form at the beginning. If there is no any data about yarn unraveling order, all yarn ends in the fabric to be unraveled is aligned by the controller in order to test arbitrarily. The tension mechanism and the yarn feeders of the same system are activated individually by the controller and then whether the yarns are in a suitable form to be unraveled is controlled. This tension is maintained for some period of time. The yarns which does not come within this duration is loosened and the untested yarn following the order is tested. Maintaining the tension on the unravelable yarn, the unraveling operation of the said yarn is continued. If a yarn comes after the yarn which has been tested but has not come, for further test the said yarn is placed in the order behind those to be tested. After the yarns placed in the order previously for test are tested, the said yarn is tested again. If the last tested yarn does not come and there exists no any other yarn in the order, the detection of the order is finished. The yarns which has not come are defined as passive and those which has come are defined as active. When the yarn being subjected to unraveling operation is stopped up, the winding operation stops and the tension mechanism of that yarn is loosened. When all of the other yarns are stopped up, the yarns which could have been unraveled are tested individually, starting the yarn which begins to be unraveled at first according to the predetermined order. If all of these yarns or several of them come, the yarns coming at that time maintains their activity and those which do not come are determined as passive. In this case, these yarns defined as passive are not tested again. When no any active-defined yarn exist in the system it is turned to the beginning and operations carried out through out this paragraph are repeated. But an alignment is made by taking the previous unraveling order as basis in this test ordering, the yarn, which has the most possibility to come, is tested first. If no any yarn comes, this test repetition is repeated as much as the programmed preset value and possible entanglements are eliminated by intervention of the operator after stopping the tests.

In the other usable choice of the method of the present invention, the said choice being defined as continuous test in the machine, while continuing the unraveling operation of the unraveled yarns in the system, at the same time, the test of the stopped-up yarn is continued individually. This alignment is made according to a program data, the said program data predicting the yarn which comes probably arbitrarily or at first. If no any yarn comes, the test repetition is repeated as much as the programmed preset value and possible entanglements are eliminated by intervention of the operator after stopping the tests.

In the choice of the present invention other than that is defined as the continuous tension mode in the machine, if there exist at least one unravelable yarn in the system, all of the yarns are kept in stretched form. But as soon as whole yarns in the system stops all of the yarns are loosened and they are tested by stretching and loosening respectively and the yarn, which is unraveled before, is searched. This alignment is made according to a program data, the said program data predicting the yarn which comes probably arbitrarily or at first. When at least one yarn begins to be unraveled, all of the yarns are stretched and are kept in this to form. This alignment is made according to a program data, the said program data predicting the yarn which comes probably arbitrarily or at first. If no any yarn comes, the test repetition is repeated as much as the programmed preset value and possible entanglements are eliminated by intervention of the operator after stopping the tests.

The choice of separation of plies, which can be used together with three different choices of the present invention described above, is described as the mode of separation of plies in the machine. This choice is used in the knits formed by more than one yarn ply. When each of the yarn plies is desired to be separated in this knit, the mechanisms wherein ends of the yarn plies are connected thereto are subjected to a test at the same time, in the knit order determined during the test. During the stoppage, each of them is loosened independently.

Figure 13:
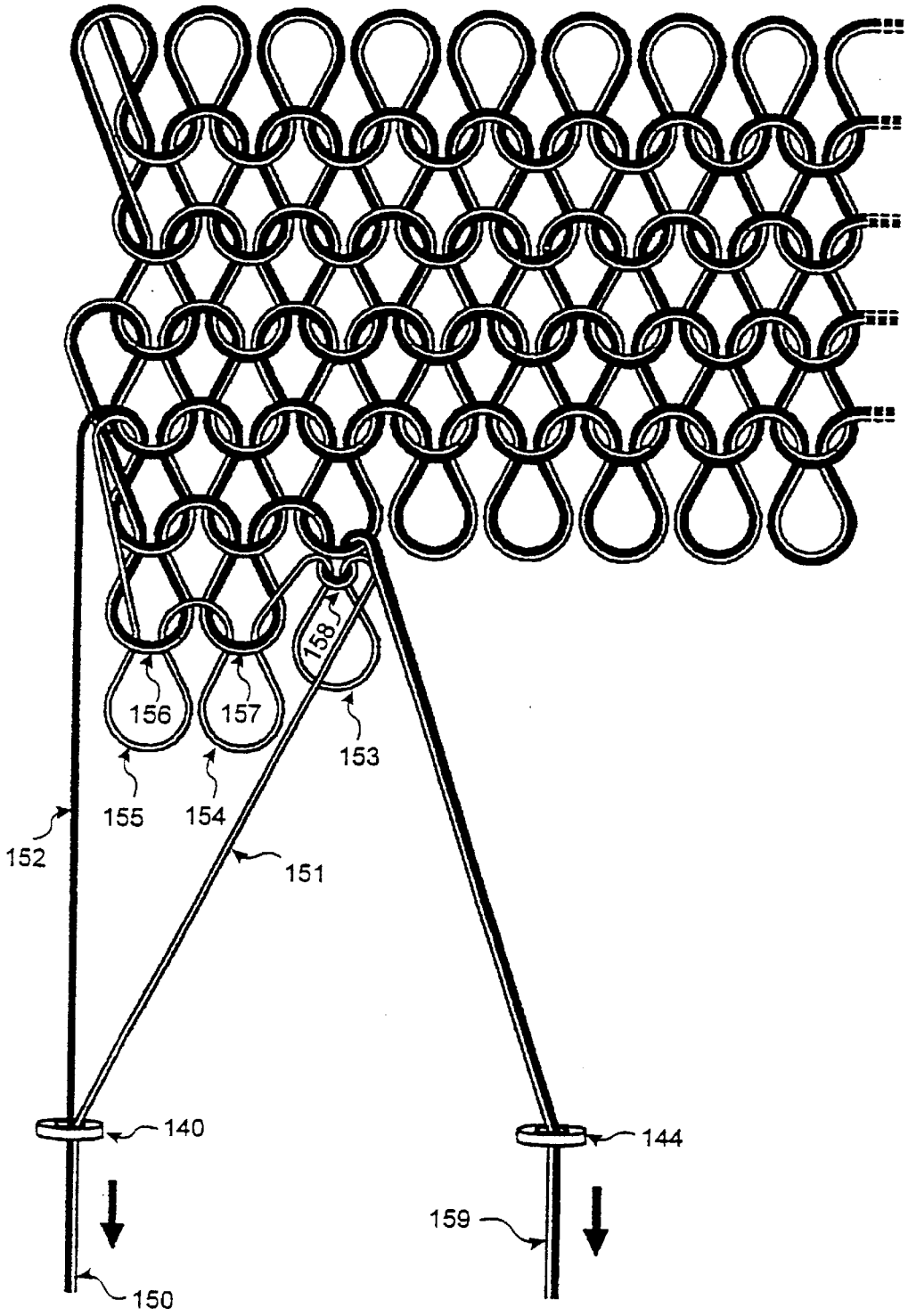
FIG. 13 is the schematic view of a problem when the yarns in a fabric knitted by using two different yarn with one ply in the same loop are pulled together in order to be unraveled.

In the event of that the same knit order is formed by more than one yarn, the problem of separation of plies appears: In case of that a fabric knitted by a yarn with two plies is unraveled together with its own plies, the yarn (150) with two plies are pulled by a tension mechanism with each other and are unraveled (FIG. 13). But during the knitting, due to the different extensions forming since the plies of the yarns being used have different features and there are the resistance differences in the yarn feeding systems of the knitting machines, although the yarn ply (152) is stopped up after reaching to the knit end, the loops (153, 154, 155) of one of the yarn (151) with two plies can not be unraveled and then the said yarn (151) can not complete the unraveling work which it should perform at that moment. For this reason, unraveling of the loops (153, 154, 155) which is the continuation of the yarn (159) to be unraveled, the said yarn having two plies, being in the upper order, does not occur. Therefore, there will be a stoppage, the machine will not be able to overcome this stoppage by testing to stretch and loosen. For this reason, the following method has been developed:

The unraveled yarns in the course of unraveling, or testing, or stopping of the yarns in a knitted fabric are twisted separately or together according to the arms of the machine for unraveling knitted fabrics wherein they are attached, during unraveling operation in a false way, carried out by a mechanism (FIG. 7-*b*). In the course of that the yarns knitted together with two plies are unraveled, by the use of this method it is winded on the separate yarn plies in the unraveled yarn pinch due to the twisting operation performed, the said yarn plies being those which are more stretched naturally. The separation of the yarn plies from each other due to tension, quality, or other reasons is prevented and for these reasons it is prevented that they make the unraveling operation difficult. Furthermore, during unraveling of the knits formed by yarns with single or multi-plies by the said method; the stoppages of tangle and entanglements of the yarn pinches can be prevented by means of torque to be formed in the yarn by twisting operation.

Figure 14:
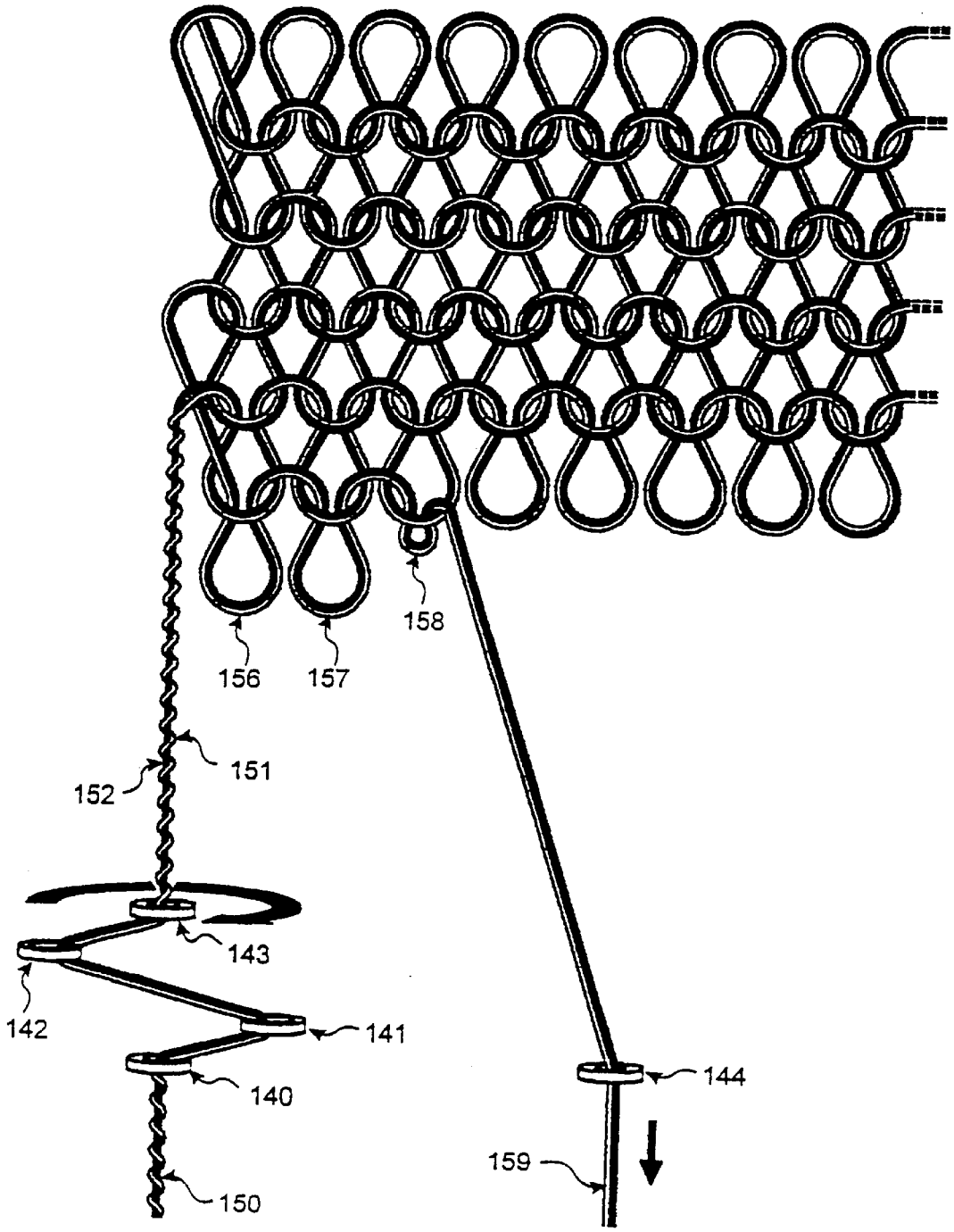
FIG. 14 is a schematic view wherein the problem in the FIG. 13 is eliminated by twisting the arms together at the instant that the yarns are stopped up.
Figure 15:
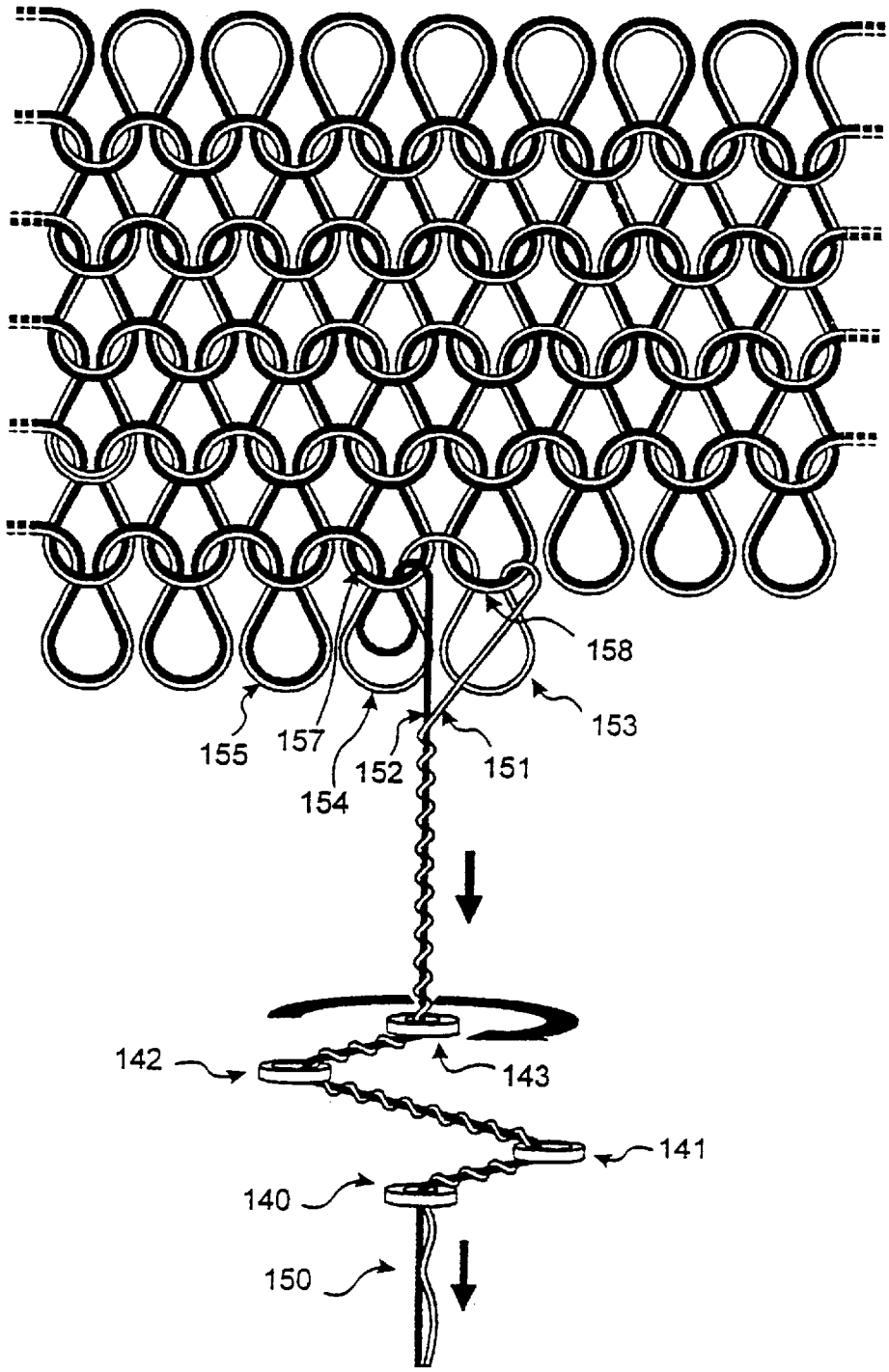
FIG. 15 is a schematic view wherein the yarns are twisted together at the instant that the yarns are unraveled in order not to meet the problem arisen in the FIG. 13.

Hence, the stoppage formed during unraveling of the yarn desired to be unraveled with two plies (FIG. 13) can be solved by giving a false twist to the said yarn at the end of the knitting order (FIG. 14), or during unraveling operation (FIG. 15). The yarn guide passage (140) in the center and another passages (141, 142) opened outwardly are rotated with a very high speed and in the axis of the yarn flow direction during unraveling operation in order to give the yarn a false twist. Therefore, due to the frictions at the inner surfaces of the yarn guide passages (141, 142), the yarn guided through those takes a false twist in an axial form. This twisting operation results in that the yarn ply (151) which is in more loosened form by extending upwardly is winded onto the yarn ply (152) which is in more stretched form naturally. In this way, the yarn plies could have been unraveled without separation, or with minimum separation. Since the said twisted yarns (150) are guided through this rotating passages in the twisted form, the twisting operation is carried out in the reverse direction of twisting automatically after they are guided through the yarn guide passage (140) in the center. So the twisting amount on the yarns has been removed and they have been brought into the untwisted form. At the end of the knit, also the twisting operation performed when there is a stoppage in the yarn (150) provides that it can take a twist at the winding side of the yarn (150) in the reversed direction (FIG. 14) such that the twisting operation is stopped when the said stoppage is eliminated, and in this case, the friction on the yarn guide passages (140, 141, 142, 143) coming to the same axial position and the yarn (150) has been removed, and in this case, the reverse twists at the lower and upper sides of the passages (140, 141, 142, 143) is opened by compensating due to the tension of the reverse twisting on each other, and they take the untwisted form (FIG. 7-*a*). The said unraveled yarns (150) go together to the tension mechanism and then to the bobbin to wind them (FIG. 7-*b*).

The false twisting operation mentioned above is carried out by means of a mechanism, the said mechanism being opened by a centrifugal force with high speeds of the yarn guide passages providing the twisting such that it turns right and left and the said mechanism then performing the twisting, and being closed in low speeds and then providing that the yarn is left as untwisted (FIG. 6-*b*). The false twisting mechanism is actuated by means of a motor (33), to which cylinders (18, 19) rotating in both two direction (FIG. 3). The motor turns the false twist housing (34) simultaneously and so it provides that the yarn is twisted, the said motor rotating the cylinders in the direction of yarn flow during test and unraveling (FIG. 6-*b*). After the tension on the tension arm (1) mentioned above are removed, the motor provides that the twisting claws (39, 40) closed by means of springs (41–42) in the false twisting apparatus (16) (FIG. 5-*b*) can move freely in both two direction of the yarn flow (FIG. 6-*b*) since the motor (33) rotates with less speed backward and then at the same time, it turns the false twisting apparatus (16) backward more slowly.

The claws (39, 40) of the said false twisting apparatus (16) is closed since it rotates in stagnant form or with low speeds (FIG. 5-*a*, FIG. 5-*b*), and since it rotates with high speed its claws (39, 40) are opened in order to carry out the twisting operation. There exist claws (39, 40) with hollow middle part, within the housing-like portion placed in the anti-friction bearings (36) in the body of the said false twisting apparatus (16), the said claws being fixed with shafts (43, 44) and being allowed to move around the said shafts, being identical to each other but being placed symmetrically and inversely. Some grooves are formed toward the direction of yarn flow in order to increase the radial friction of the yarn (100) guided through the hollow of the said claws (39, 40). Further, there exist some springs (41, 42) between the lateral surface of the housing (34) rotating by these claws and the claws (39, 40). While this system is in the stagnant form or is rotating with a low speed, the said springs provide that the claws are kept in the center, the said system comprising all of the portions connected onto the rotating housing (34). Hence the yarn (100) can be guided through the hollows of the claws (39, 40), the upper passage (37), and through the lower passage (38) without being subjected to any resistance in any direction (FIG. 5-*a*). In high speeds, the claws (39, 40) connected onto the rotating housing (34) overcomes the resistance of the springs (41, 42) by the centrifugal force occurring due to high speeds and is opened outwardly. The yarn guide passages (141, 142) in the claws (39, 40) opened in said way take the required position and then carry out the false twisting operation (FIGS. 14 and 15).

Figure 4:
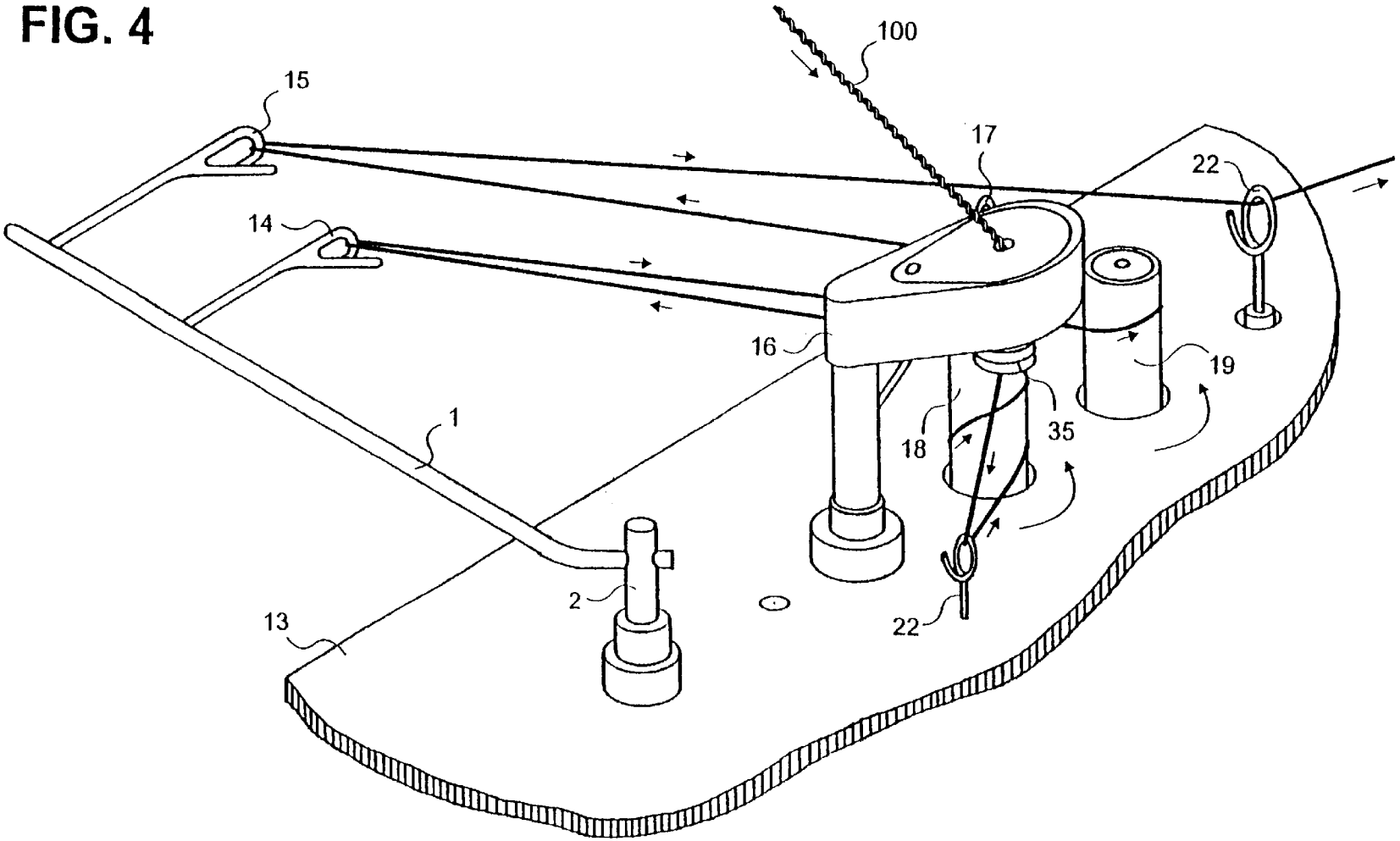
FIG. 4 is three-dimensional view of a mechanism in operative position, used for unraveling only knits with yarns having more than one ply, in one section of a machine surface table whereon a single unraveling unit of the machine for unraveling knitted fabrics is contained.

The said mechanisms are actuated by the yarn feeders (18, 19) which also reduce the friction resistance of the yarn (FIG. 4). The twisting mechanism (16) connected to a separate shaft is kept in inert form in order to be used when necessary (FIG. 3). There exist a spring (30) between a fixed support (29) and a crank arm (31) connected to this twisting mechanism (16). The said spring (30) is adjusted such that it can maintain the said mechanism in an inert position when it is not used, and it can supply the pressure, which is required so that the twisting mechanism is actuated by the yarn feeding cylinder (18) of the rubber surface (35), when it is turned countercurrent (FIG. 3).

The machine for unraveling knitted fabrics is controlled by an electronic control unit with a microprocessor. The said machine being manufactured by combining more than one knitting system is designed such that when it is desired to unravel more than one tricot part at the same time, the control system can carry out unraveling of the said parts separately and independently from each other.

What is claimed is:

1. A method for unraveling fabrics knitted by yarn or yarn plies, comprising the steps of:

testing unravelability of yarn forming the fabrics by stretching said yarn for inducing tension in the yarn for a period of time, in a sequential order and by a stretching amount to determine unravelability, wherein unravelable yarn and non-unravelable yarn are detected;

winding the unravelable yarn by winding units while tension on the unravelable yarn is maintained;

reducing tension on the non-unravelable yarn for a period of time, in a sequential order and by a stretching amount; and terminating winding of the unravelable yarn, when the unravelable yarn is not able to be unraveled anymore, and reducing the tension on the unravelable yarn for a period of time, in a sequential order and by a stretching amount.

2. A method for unraveling knitted fabrics according to claim 1, said step of testing unravelability further comprising the steps of:

stretching individually each yarn to determine an unraveling sequence, forming a testing sequence to start unraveling and winding the unravelable yarn by winding units as tension on the unravelable yarn is maintained;

reducing tension on any tested non-unravelable yarns for a period of time, in a sequential order and by a stretching amount and then testing untested yarns; and re-testing non-unravelable yarns previously tested in a sequence after detecting any unravelable yarn or after detecting any new unravelable yarn; and continuing to test remaining non-unravelable yarns until all unravelable yarn is detected whereby an unraveling sequence of yarn is determined.

3. A method for unraveling knitted fabrics according to claim 2, further comprising the steps of:

starting an unraveling of the unravelable yarn according to the unraveling sequence of yarn, wherein said unraveling sequence comprises unraveling until the yarn reaches a knit end of fabric;

continuing the unraveling of the unravelable yarn and stopping testing of the non-unravelable yarn when unraveling in the unraveling sequence; and determining a substitute unraveling sequence, if unraveling in the unraveling sequence is disrupted.

4. A method for unraveling knitted fabrics according to claim 3, further comprising the following steps of:

continuing testing of the non-unravelable yarn, when unraveling in the unraveling sequence; and modifying the unraveling sequence if any non-unravelable yarn is determined to be unravelable.

5. A method for unraveling knitted fabrics according to claim 1, said step of testing unravelability further comprising the steps of:

stretching individually each yarn to determine an unraveling sequence, forming a testing sequence to start unraveling and winding the unravelable yarn by winding units as tension on the unravelable yarn is maintained;

keeping the unravelable yarn and non-unravelable yarn stretched when there is at least one unravelable yarn detected in the fabric;

winding the stretched unravelable yarn, by winding units as tension on the unravelable yarn is maintained; and loosening tension on non-unravelable yarn when there is no unravelable yarn remaining and re-starting testing of all remaining yarn.

6. A method for unraveling knitted fabrics according to claim 1, further comprising the following steps of:

repeating said step of testing unravelability during unraveling as set for a number of testing times by an operator and then stopping repeating by said operator; and eliminating any entanglement in the unravelable yarn and non-unravelable yarn by manual intervention by the operator.

7. A method for unraveling knitted fabrics according to claim 1, further comprising the step of:

testing simultaneously an individual yarn of a plurality of yarn plies of the fabric, wherein the fabric is comprised of more than one yarn ply, wherein each yarn ply is formed of an identical pattern of unravelable yarns and non-unravelable yarns, and wherein each yarn ply is wound separately.

8. A method for unraveling knitted fabrics according to claim 7, further comprising the step of:

false twisting together said individual yarn of the plurality of yarn plies by a rotating friction force applied radially in a region between the fabric and respective winding units of said individual yarn wound thereon, wherein said individual yarn of the plurality of yarn plies are wound together when unraveling the fabric.

9. A method for unraveling knitted fabrics according to claim 8, wherein the step of false twisting further comprises:

continuing testing unravelability of each individual yarn of the plurality of yarn plies.

10. A machine for unraveling knitted fabrics comprised of at least one unraveling unit, said unraveling unit comprising:

at least one yarn winding unit comprising yarn winding elements and a tension/reservoir arm having at least one yarn guide passage thereon, said tension/reservoir arm being pivotable around an arm shaft so as to stretch and loosen yarn when unraveling fabric and testing unravelability of yarn;

a mechanically, electrically, hydraulically, or pneumatically operated actuator having an increasing moment on said tension/reservoir arm to stretch yarn and a decreasing moment on said tension/reservoir arm to loosen of yarn; and a mechanically or electronically operated sensor located at a predetermined position on the tension/reservoir arm.

11. A machine for unraveling knitted fabrics according to claim 10, further comprising:

an electronic controller operatable synchronously with said unraveling unit connected thereto, wherein signals are received and sent between said electronic controller, operated sensor and said actuator for operation of said unraveling units.

12. A machine for unraveling knitted fabrics according to claim 10, wherein the mechanically operated actuator further comprises:

a spring fixedly connected to said tension/reservoir arm, wherein a transmission of a force increases and decreases moment of said actuator to said tension/reservoir arm.

13. A machine for unraveling knitted fabrics according to claim 10, wherein said unraveling unit further comprises:

at least one yarn feeder having a surface velocity faster than a yarn flow rate, said yarn feeder comprising a plurality of cylinders with surfaces that pass yarn on said yarn feeder by winding said yarn thereon and that eliminate yarn tension caused by friction on said yarn guide passages, and an electrical motor rotatingly driving said yarn feeder in a forward direction for stretching yarn and in a backward direction for loosening yarns.

14. A machine for unraveling knitted fabrics according to claim 10, wherein said unraveling unit further comprises:

at least one movable yarn guide passage able to provide false twisted yarn to said winding unit by a radial friction force, wherein said movable yarn guide passage is displaced by a centrifugal force while rotating.

15. A machine for unraveling knitted fabrics according to claim 14, wherein said unraveling unit further comprises:

a motor actuatable with said movable yarn guide passage and a yarn feeders.

16. A machine for unraveling knitted fabrics according to claim 10, wherein said unraveling unit further comprises:

a mechanical or an electrical switch actuatable by tension or flow of yarn guided thereon and in electronic communication with said control unit so as to receive and send signals about breakage of yarn during unraveling and testing, said electrical switch being positioned in a passage where yarn is guided.

17. A machine for unraveling knitted fabrics according to claim 10, wherein said winding unit of said unraveling unit has a yarn winding drum, an electrical motor, and a bobbin, wherein yarn is wound around said winding drum, said yarn winding drum being a hollow cylinder shaped, having plurality of guiding slots for yarn, and having a roughened surface engageable with said bobbin, and wherein said bobbin is rotatable and stoppable as said bobbin engages said roughened surface of said yarn winding drum.

18. A machine for unraveling knitted fabrics comprised of at least one unraveling unit, said unraveling unit comprising:

at least one yarn winding unit comprising yarn winding elements and a tension/reservoir arm having at least one yarn guide passage thereon, said tension/reservoir arm being pivotable around an arm shaft so as to stretch and loosen yarn when unraveling fabric and testing unravelability of yarn;

a fixed spring maintaining a stretched form of said tension/reservoir arm without any driven actuators, wherein forward rotation of said fixed spring relative to the yarn winding unit increases moment on said tension/reservoir arm to stretch yarn, and wherein reverse rotation of said fixed spring relative to the yarn winding unit decreases moment on said tension/reservoir arm to loosen of yarn; and a mechanically or electronically operated sensor located at a predetermined position on the tension/reservoir arm.

* * * * *